US006192667B1

(12) United States Patent
Wirz

(10) Patent No.: US 6,192,667 B1
(45) Date of Patent: Feb. 27, 2001

(54) SPIN DRAW TEXTURIZING OR DRAW TEXTURIZING MACHINE

(75) Inventor: Armin Wirz, Ossingen (CH)

(73) Assignee: Maschinenfabrick Rieter AG, Winterthur (CH)

( * ) Notice: Subject to any disclaimer, the term of this patent is extended or adjusted under 35 U.S.C. 154(b) by 0 days.

(21) Appl. No.: 09/217,713

(22) Filed: Dec. 21, 1998

(30) Foreign Application Priority Data

Jan. 14, 1998 (CH) ..... 0058/98

(51) Int. Cl.[7] ..... D02G 1/02; D02G 1/16

(52) U.S. Cl. ..... 57/351; 57/333; 28/220; 28/271

(58) Field of Search ..... 28/271, 273, 274, 28/247, 258, 268, 220; 57/333, 351, 908, 350

(56) References Cited

U.S. PATENT DOCUMENTS

| | | | | |
|---|---|---|---|---|
| 3,204,396 | * | 9/1965 | Foster et al. | 57/333 |
| 3,555,808 | * | 1/1971 | Gutmann, Jr. | 28/271 |
| 3,636,599 | | 1/1972 | Stanley . | |
| 4,055,039 | * | 10/1977 | Movshovich et al. | 57/333 |
| 4,070,817 | * | 1/1978 | Bueb et al. | 57/908 |
| 4,242,862 | * | 1/1981 | Negishi et al. | 57/908 |
| 4,592,119 | | 6/1986 | Bauer et al. . | |
| 4,644,622 | | 2/1987 | Bauer et al. . | |
| 5,243,813 | * | 9/1993 | Stahlecker | 57/333 |
| 5,927,062 | * | 7/1999 | Deno et al. | 57/333 |

FOREIGN PATENT DOCUMENTS

| | | |
|---|---|---|
| 680140 | 6/1992 | (CH) . |
| 1435517 | 1/1969 | (DE) . |
| 0039763 | 11/1981 | (EP) . |
| 0026360 | 2/1985 | (EP) . |
| 0434601A1 | 6/1991 | (EP) . |
| 0310890B1 | 12/1991 | (EP) . |
| 0784109A2 | 7/1997 | (EP) . |
| 0784109A3 | 7/1997 | (EP) . |
| 8901538 | 2/1989 | (WO) . |

OTHER PUBLICATIONS

European Patent Office Search Report, Jul. 20, 1998.

* cited by examiner

*Primary Examiner*—Amy B. Vanatta
(74) *Attorney, Agent, or Firm*—Dority & Manning

(57) ABSTRACT

The inventive arrangement of bundles of fibrils in a part of a spin draw texturizing or draw texturizing machine presents a fan-type arrangement of these bundles of fibrils in which preferentially the longitudinal axes of the texturizing nozzles taking up the bundles of fibrils extend coaxially with a connecting line extending from a delivery point on a draw roll to the outlet of each individual texturizing nozzle.

5 Claims, 4 Drawing Sheets

SPIN DRAW TEXTURIZING OR DRAW TEXTURIZING MACHINE

BACKGROUND OF THE INVENTION

The present invention concerns the guidance of bundles of fibrils through a part of a spin draw texturizing machine or a draw texturizing machine comprising of a texturizing unit disposed downstream from a pair of draw rolls. The texturized unit has individual texturizing nozzles incorporating a transportation portion and a texturizing portion in which the bundles of fibrils are texturized.

In a texturizing method from the European patent application EP 0 784 109 A1, a plurality of individual bundles of fibrils simultaneously are drawn on a pair of draw rolls and subsequently are texturized in a texturizing unit with a plurality of texturizing nozzles arranged side by side. In this method, it is found that the individual bundles of fibrils are guided on the pair of draw rolls spaced by smaller mutual distances than the distances required from one texturizing nozzle to the next.

As on the other hand, the design height of the machine is to be kept as low as possible in order to permit stringing up of the filament bundles. These filament bundles are sucked in at high speed by means of a so-called suction gun and transported as quickly as possible from one end of the machine to the other end. For this purpose, the distances between the individual operating units are to be kept as small as possible.

These requirements concerning the spacing distances prove particularly disadvantageous in guiding the bundles of fibrils between the supplying draw roll and the texturizing unit. As mentioned, the spacing distance from one bundle of fibrils to the next is to be kept as small as possible, whereas the distance from one texturizing nozzle to the next for various reasons, e.g. concerning lay-out dimensions, must be substantially larger. Thus, the bundles of fibrils must fan out considerably from the draw roll and must be deflected upstream from, or directly at, the inlet into each individual texturizing nozzle.

In this arrangement, the smaller spacing distance from one bundle of fibrils to the next within a group of bundles differs from the somewhat larger distance from one group to the next.

In order to maintain the group distance between the last group, second to last group, and outermost group, in spite of the fanning out of the bundles, guide elements must be provided between the individual draw rolls of a pair of draw rolls. These guide elements guide the last group of bundles of fibrils on the draw roll distanced far enough from the second to last group of bundles of fibrils that, in spite of the delivery width of the last bundles of fibrils from the roll to the texturizing unit, the distance between groups can be provided acceptably large enough that neither rolls of excessive length are required. Also, the danger does not arise that the fanned-out bundles of fibrils of the last group overlap the bundles of fibrils of the preceding group still located on the roll.

The above mentioned guide elements, be it deflecting elements arranged between the rolls or deflecting elements arranged upstream from the inlet of each individual texturizing nozzle, present the disadvantage that they inherently generate a uncontrollable extent of damage to the individual bundle of fibrils, e.g. deformations to the fibril cross-section. The extent of damage is uncontrolled in so far as the deflection, particularly the deflections upstream from the inlet to each individual texturizing nozzle, differs from one texturizing nozzle to the next. These deflections happen in such a manner that differences in the texturizing effect can be generated, which possibly will be visible in the finished product, e.g. in a carpet.

Furthermore, it is known from the Swiss patent application CH 680 140A5 that texturizing nozzles are laid out at their inlet portion. The texturizing and transporting air for taking over the bundle of fibrils is injected into these texturizing nozzles in such a manner that the air injected imparts a twist to the bundle of fibrils. This twist is propagated against the direction of transport of the bundle of fibrils up to a twist stop and is called a false twist. A false twist of this type is generated in order to impart compactness to the bundle of fibrils in such a manner that individual fibrils sticking out are better tied into the bundle in order to obtain an evening effect in the bundle of fibrils.

It has been found, however, that in case the bundles of fibrils are transferred from a draw roll directly into the inlet of the texturizing nozzle, the false twist mentioned above tends to move the individual bundles of fibrils on the roll surface corresponding to the twist direction in the axial direction of the roll. This movement happens in such a manner that a certain migration of the bundles of fibrils in axial direction occurs up to the zone of the roll surface. Owing to the tensile force in the thread on the roll surface, a contacting pressure is generated, which presses the bundles of fibrils against the roll surface in such a manner that a twist stop is formed.

If now, as mentioned already, the bundles of fibrils must be guided in a fan-type arrangement from the roll towards the individual texturizing nozzles, the twist has different effects depending on the angle position of the respective bundle of fibrils in the fan type arrangement. For example, a certain position of a bundle of fibrils can counteract the migration along the envelope line of the roll, whereas another position assists this migration further resulting in a jittery movement of the respective bundle of fibrils.

The disadvantages of the arrangement mentioned above consist in that due to the different compacting action exerted onto the individual bundles of fibrils by the twist or by the jittery movement, respectively, an uneven texturizing effect varying from one bundle of fibrils to the next may be generated. The uneven texturizing results, as mentioned before, are visible and disadvantageous differences in the finished product, e.g. in a carpet.

OBJECTS AND SUMMARY OF THE INVENTION

It thus is a principal object of the present invention to create a device to eliminate the uneven texturizing effect on different bundles of fibrils which cause visible and disadvantageous differences in finished products.

Additional objects and advantages of the invention will be set forth in part in the following description, or may be obvious from the description, or may be learned through practice of the invention.

Once preferred embodiment of the present invention comprises a guidance of bundles of fibrils through a part of a spin draw texturizing machine or draw texturizing machine comprising a texturizing unit arranged downstream from a pair of draw rolls with individual texturizing nozzles each with a transporting portion and a texturizing portion in which individual bundles of fibrils are texturized. The guidance of bundles of fibrils are characterized in that the bundles of fibrils each between a roll of the pair of draw rolls, from which the bundles of fibrils are delivered to the texturizing unit, and the individual texturizing nozzles are subject to a predetermined false twist directed in such a manner that the twist induces the corresponding bundle of fibrils to roll on the roll surface in the direction in which the thread tension between the roll and the corresponding texturizing nozzles increases.

In the sense of an example merely, the present invention is explained in the following with reference to illustrated design examples. It is shown in the:

BRIEF DESCRIPTION OF THE DRAWINGS

FIG. 8 A cross-section of the detail according to the

FIG. 7 seen in a section along the line II—II according to the FIG. 7.

DETAILED DESCRIPTION

Figure 1:
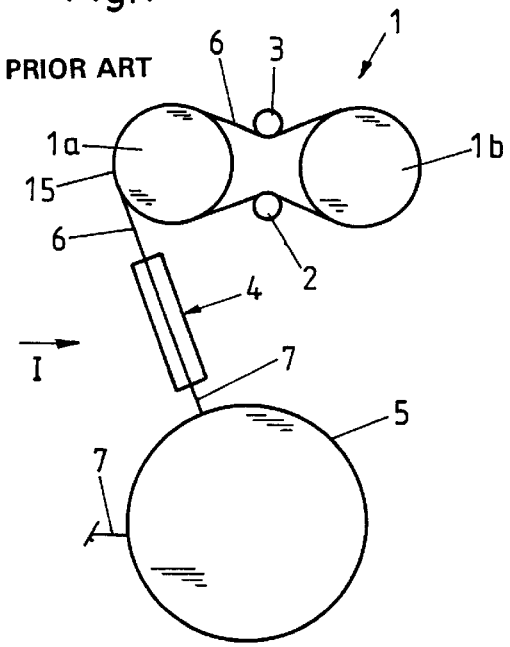
Fig.1 PRIOR ART
FIG. 1 A view according to the state of the art hampered by disadvantages.

Reference will now be made in detail to the presently preferred embodiments of the invention, one or more examples of which are illustrated in the drawings. Each example is provided by way of explanation of the invention, and not meant as a limitation of the invention. For example, features illustrated or described as part of one embodiment can be used on another embodiment to yield a still further embodiment. It is intended that the present application include such modifications and variations.

In the FIG. 1 a pair of draw rolls, also called duo, is shown with the draw rolls 1A and 1B on which individual bundles of fibrils 6 are placed in groups 6.1, 6.2 and 6.3 which, in combination with a further preceding pair of draw rolls, are drawn in a manner known as such.

Figure 2:
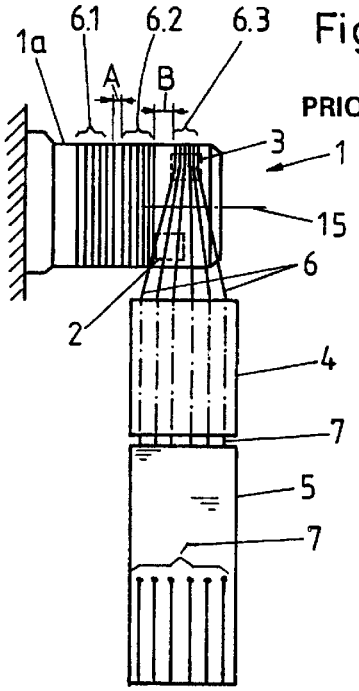
Fig.2 PRIOR ART
FIG. 2 A side view according to the FIG. 1 seen in the direction I (FIG. 1)

In this arrangement, as shown in the FIG. 2, the groups are kept spaced by a distance A.

The bundles of fibrils of the last group 6.3 (FIG. 2) are deflected and guided by a lower deflecting guide element 2 provided between the draw rolls 1A and 1B, and by an upper deflecting guide element 3, arranged somewhat more towards the front of the free end of the rolls 1A and 1B. The upper deflecting guide element also is arranged between the draw rolls 1A and 1B in such a manner that the last bundle of fibrils 6.3 on the roll 1A is spaced by a distance B from the preceding group 6.2. Distance B is larger than the distance A between the groups 6.1 and 6.2 of bundles of fibrils. For this purpose, the deflecting elements 2 and 3 each are provided with a groove for each bundle of fibrils. This precludes that bundles of fibrils of the last group 6.3 contact each other or even overlap at a delivery point 15. This contact is due to the fan type arrangement implied by the much larger distance from one texturizing nozzle center to the next of the individual texturizing nozzles 8 than the distance from one bundle of fibrils to the next within the group 6.3. In this arrangement, the deflecting elements 2 and 3 can be laid out as stationary elements or as rolls driven by the bundles of fibrils.

Furthermore, the delivery point is represented by an imagined straight line 15 extending parallel to the roll axle, also called envelope line, on which the bundles of fibrils pass arranged mutually parallel.

The bundles of fibrils 6 entering the texturizing unit 4 at the inlet of the texturizing unit 4, as shown in the FIG. 2, are deflected at the inlet of each texturizing nozzle due to the fan-type arrangement of the bundles of fibrils between the delivery point 15 and the inlet into the texturizing unit 4.

The deflection of the bundles of fibrils 6 on the lower deflecting element 2 and on the upper deflecting element 3 as well as the deflection at the inlet into the texturizing unit 4 can cause undesirable damage differing from one bundle of fibers to the next due to the friction the bundles of fibrils are subjected to. This uncontrollable variation can result in an unevenness in the finished thread.

Figure 4:
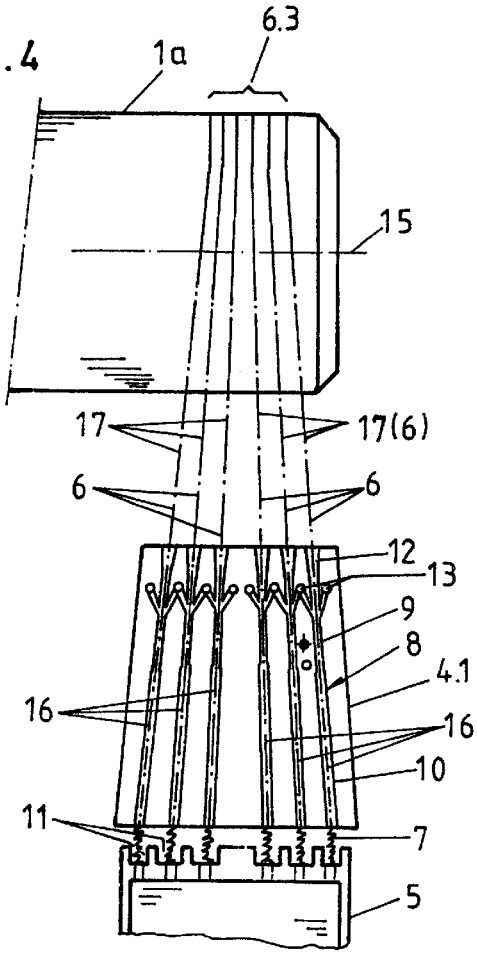
FIG. 4 An enlarged side view according to the FIG. 3 seen in the viewing direction II (FIG. 3)

In order to remedy this disadvantage, the individual texturizing nozzles 8, as shown in the FIG. 4, are arranged in a fan type arrangement in such a manner that the longitudinal axis 16 of each texturizing nozzle 8, indicated with dash-dotted lines, extends coaxially with a connecting line 17, shown with dash-dotted lines, which extends from the delivery point 15 to the exit of each texturizing nozzle 8. In this arrangement, the connecting lines 17 at the same time correspond to the path of the individual bundles of fibrils 6 from the delivery point 15 into the corresponding individual texturizing nozzle 8.

Figure 3:
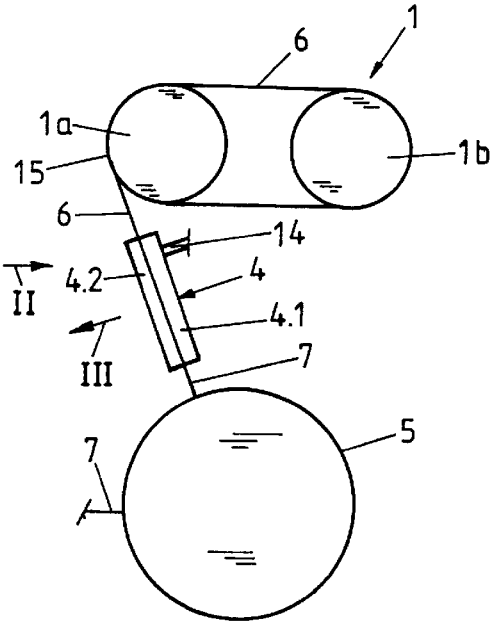
FIG. 3 A view analogous to the FIG. 1 but with an inventive arrangement and without the disadvantages according to the state of the art.

Owing to this fan type arrangement of the texturizing nozzles 8, as shown in the FIGS. 3 and 4, all deflecting elements mentioned above between the rolls 1A and 1B and upstream from the texturizing nozzles 8 can be dispensed with.

The texturizing nozzles 8 each supply a texturized bundle of fibrils to a cooling drum 5 allowing each into a cooling path provided for a bundle of fibrils.

The cooling drum 5 is an element known as such from the EP 0 310 890 B1 and is not described further here.

In the FIG. 4, only one half shell 4.1 of the texturizing unit 4 according to the FIG. 3 is shown. The other half shell 4.2, as shown in the FIG. 3, is taken off in the direction III or is tilted open. This is shown here merely to facilitate the illustration of the path of the individual bundles of fibrils 6 and illustration of the individual texturizing nozzles 8.

Texturizing units 4, which can be tilted open, have been shown and described already in the European patent EP-0 026 360 B1 and in EP-0 039 763 B1 and are not re-described here in detail.

As shown also in the FIG. 4, the individual texturizing nozzles 8 are supplied with a transporting medium via a transporting medium distributing duct 13 by an injection pump system. The bundles of fibrils 6 by means of the transporting medium are sucked into the individual texturizing nozzles 8 and through the transporting portion 9 into the texturizing portion 10, where the bundles of fibrils are texturized into a plug, or a texturized bundle of fibrils. From there the texturized bundles of fibrils are transferred into an individual cooling path 11 on the cooling drum 5.

The transporting medium is fed in via a transporting medium supply duct 14 and via internal ducts (not shown) into the transporting medium distributing ducts 13.

The present invention is not restricted to the arrangement shown of the path of the bundles of fibrils on the roll 1A according to the FIG. 4. In principle, the present invention concerns a guidance of the bundles of fibrils which essentially does not cause more intense deflections. According to FIG. 4, the deflection that results from the uppermost envelope line of the roll 1A to the delivery point 15 depends on the friction between the bundles of fibrils and the surface of the roll 1A and on the thread tension generated in the individual bundle of fibrils 6. The thread tension is induced by the suction force of the individual texturizing nozzle 8, and furthermore on the surface structure of the roll 1A.

Within the scope of these variations the fan-type arrangement of the individual texturizing nozzles 8 can be varied.

Figure 5:
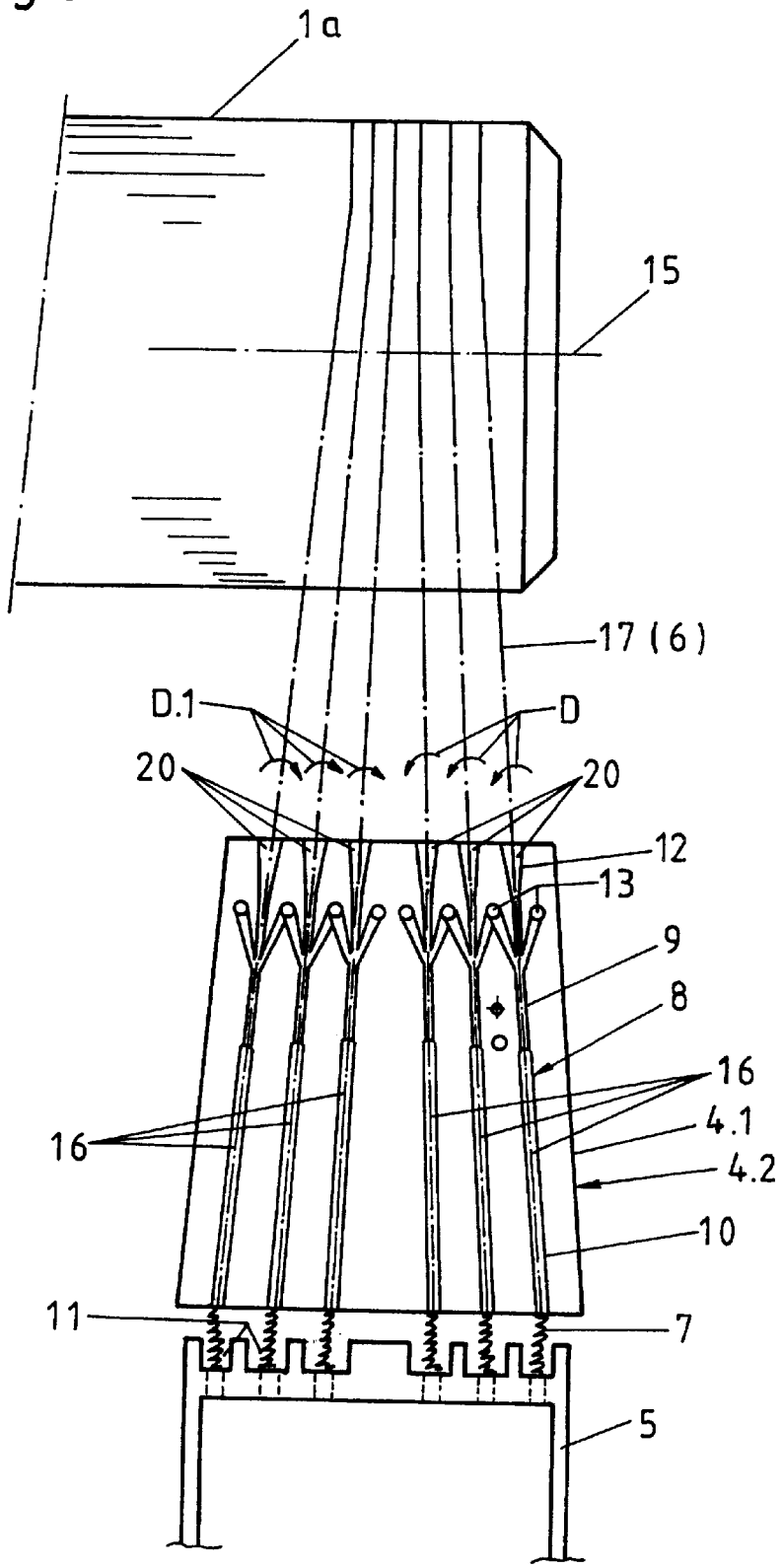
FIG. 5 An enlarged view according to the FIG. 4 with additional inventive characteristics.

In the FIG. 5, an enlarged view of the FIG. 4 is shown in which the arrows D and D1 designate a twist direction in the individual bundles of fibrils, which are guided along the connecting line 17 from the delivery point 15 into the corresponding texturizing nozzle 8.

As mentioned initially, the individual texturizing nozzles comprise means for generating a so-called false twist in the bundle of fibrils 6 between the inlet of the texturizing nozzle and the delivery point 15, according to the CH 680140A5. In this arrangement, these twist imparting means are provided in such a manner that for the first three bundles of fibrils as seen from the right hand side to the left hand side in the FIG. 5, a right hand twist D (also called clockwise twist) is seen in the direction of transport of the bundles of fibrils. For the three further bundles of fibrils, as seen from the left hand side to the right hand side in the figure, a left hand twist D.1 (also called counter-clockwise twist), is seen in the direction of transport of the bundles of fibrils is imparted.

The right hand twist of the first three bundles of fibrils tends to move the bundles of fibrils on the roll 1A from the free end of the roll 1A towards the supported end until the thread tension no longer permits such movement. In this manner, a stable thread position is established for these three bundles of fibrils at the delivery point 15 and thus also between the delivery point 15 and the inlet duct 20 of the corresponding texturizing nozzles 8. This stable position of the bundles of fibrils would not be ensured for the next three bundles of fibrils, as seen from the left hand side to the right hand side in the Figure, if these three bundles of fibrils also would be subject to a right hand twist, as due to the inclined position of these bundles of fibrils in the position shown with an additional angle-compared to the direction in which the first mentioned three bundles of fibrils—a right hand twist would assist the movement of the bundles of fibrils towards the supported end of the roll 1A due to the thread tension and due to the twist in such a manner that these bundles of fibrils would move substantially farther towards the supported end of the roll than the first three bundles of fibrils. Thus, the danger would arise that these three bundles of fibrils could overcome the distance B mentioned earlier and would collide with the neighbouring wraps of the group 6.2 or with themselves in such a manner that disturbances would be caused. A further disadvantage of this migration towards the supported end of the roll of the last mentioned three bundles of fibrils consists in that the adhesion of the corresponding bundle of fibrils on the roll surface tends to shift. The shift causes the corresponding tension to fall below the limit tension, allowing the bundle of fibrils to shift again to the right hand side towards the free end of the roll, which results in an oscillation of the bundles of fibrils in this inclined position. Thus, a jittery movement of the bundle of fibrils is generated.

According to the invention in the three bundles of fibrils mentioned, which are in the position with an additional angle, the twist is imparted in the opposite direction D1 in such a manner that these bundles of fibrils owing to the twist tend to migrate towards the free end of the roll. The migration causes, firstly, the collision with neighbouring bundles of fibrils to be prevented and, secondly, a stable position of the bundles of fibrils at the delivery point 15 and between the delivery point 15 and the corresponding texturizing nozzles to be established.

Figure 6:
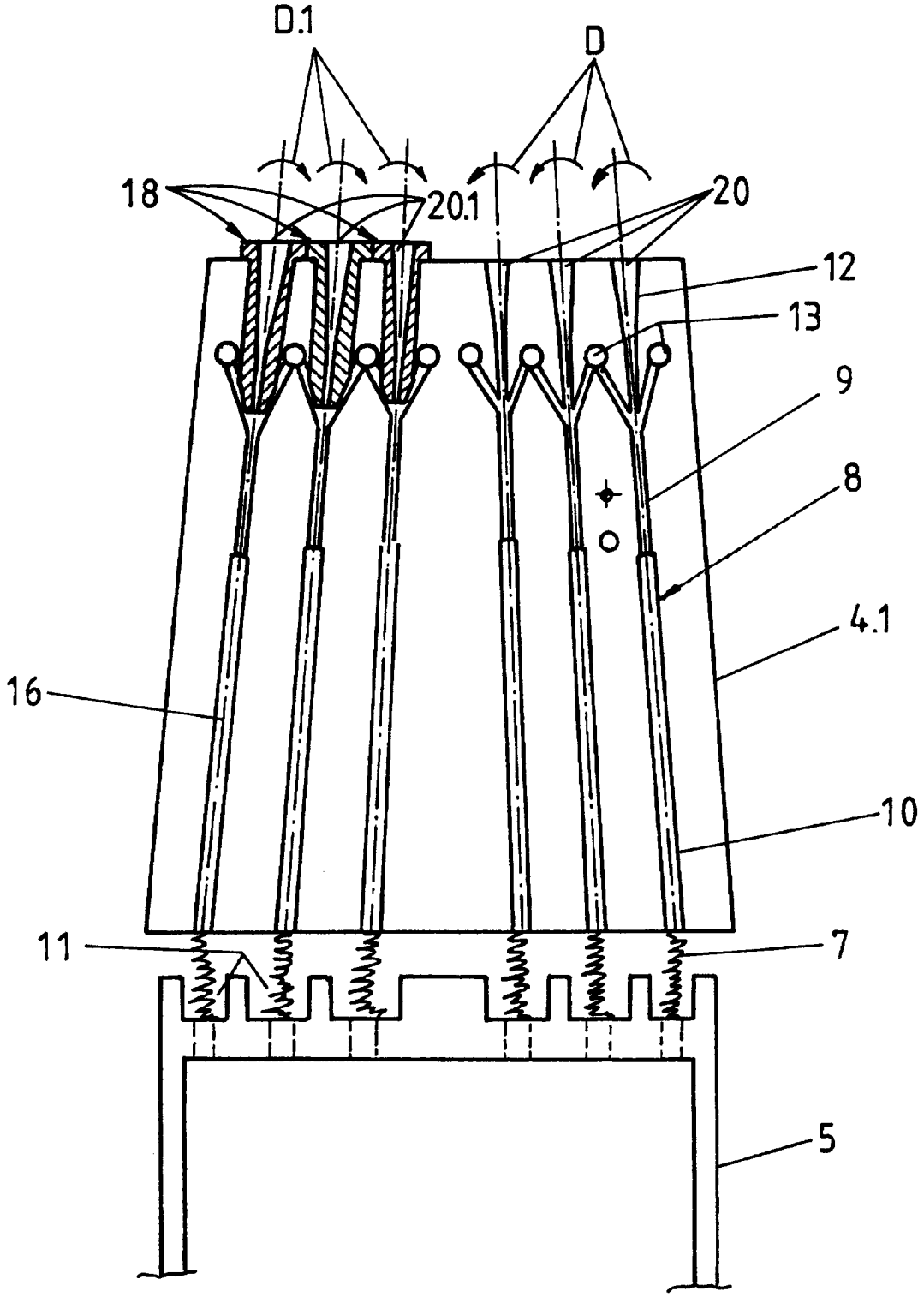
FIG. 6 A variant of a detail according to the FIG. 5, shown enlarged.
Figure 7:
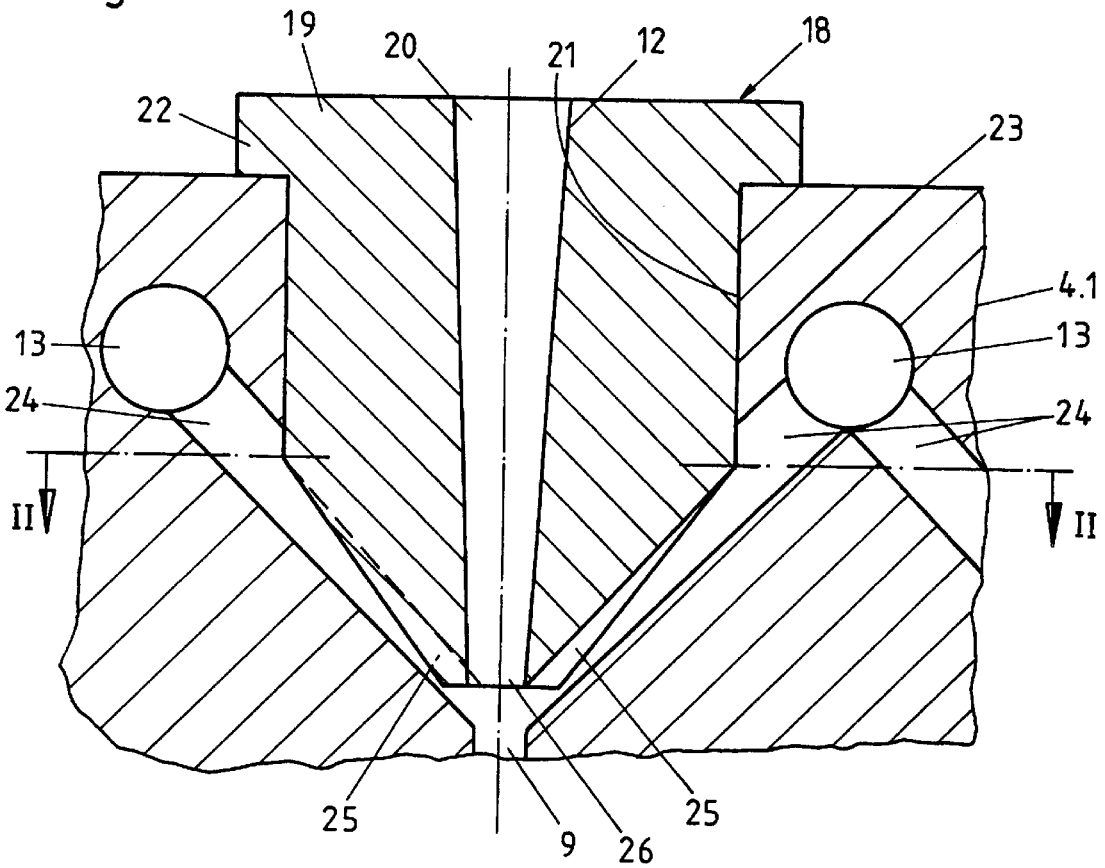
FIG. 7 A part of the detail according to the FIG. 6 shown enlarged and seen in a section along the line I—I according to the FIG. 8.
Figure 8:
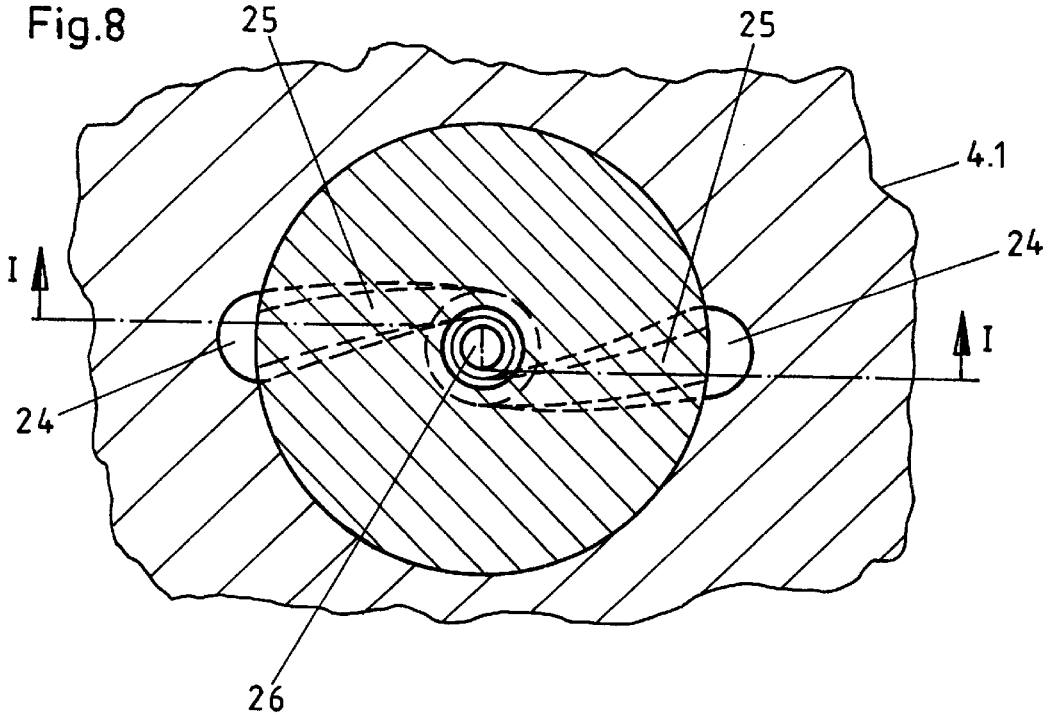

These differing twist directions in the individual bundles of fibrils (D or D1) can be provided using a pre-established arrangement of the feed air ducts according to CH 680 140A5 on a permanent basis. There is also the possibility, as shown in the FIG. 6, to lay out the inlet portion either of all texturizing nozzles 8 or only a portion of them, as an exchangeable element 19. As shown in the FIGS. 7 and 8, element 19 is provided with helical (or spiral) ducts 25, which according to the twist intensity and direction desired can be designed correspondingly. These helical ducts 25 shown in the FIGS. 7 and 8 are designed in such a manner that they impart a right hand twist D in the corresponding bundles of fibrils which pass through the inlet duct 20 of an inlet portion element. These helical ducts extend into the nozzle ducts 24, shown already in the FIG. 5 but not designated there, and form the main guidance element, as shown in the FIG. 8, for the injected transporting and texturizing air in order to correspondingly generate the twist mentioned in the respective bundle of fibrils.

These exchangeable insert elements 19 are inserted and centered in a bore 21 in the half shell elements 4.1 and 4.2 of the nozzles and are provided in two half elements just as the nozzle half shells. Seen in the transporting direction of the bundles of fibrils, these exchangeable insert elements 19 are seated with their flange 22 on a support surface 23 in the corresponding half shell of the texturizing unit 4.1 and 4.2.

Said half elements of the exchangeable insert elements 19 are fixed in the corresponding half shell of the texturizing unit using screws. The screws are guided in slots (not shown) in such a manner that the corresponding insert elements can be rotated somewhat, as permitted by the length of the slot, in order to change the effect of the twist.

In this arrangement, the twist can be adjusted while the bundle of fibrils is running until the position of the bundles of fibrils between the preceding roll and the texturizing unit assumes a stable position, i.e., no longer oscillates to and fro.

As the half elements of the insert element 19 are separated and fixed separately, the texturizing unit still can be opened and the respective bundles of fibrils can be inserted into the texturizing unit whereupon the two half shell elements are joined again for operation.

Depending on the shape of the helical ducts 25 and of the nozzle ducts 24 the speed of the air injected can be varied in the zone immediately downstream from the outlet mouth of the inlet duct 20.

Owing to the possibility of varying the helical ducts 25 and the nozzle ducts 24 and owing to the possibility to design the insert element as a shiftable element, the twist imparted to the bundles of fibrils can be varied without affecting the quantities of transporting and texturizing air.

Furthermore, it is understood that twist imparting in the bundles of fibrils in one direction or in the other (D or D.1) is applicable not only in the fan-type arrangement of the texturizing nozzles, but also can be applied in a parallel arrangement of the texturizing nozzles as shown in the FIG. 2.

Also, the present invention is not restricted to the manner of twist imparting described and shown. It is possible that a twist imparting device known as such, or not known (not shown) is provided in the corresponding path downstream from the roll 1A, which gives off the bundles of fibrils to the texturizing nozzles, as seen in the direction of the thread transport, upstream from the texturizing nozzles in order to impart a twist to the bundle of fibrils leaving the roll in a predetermined direction.

It will be appreciated by those skilled in the art that various modifications and variations can be made in the present invention without departing from the scope of the invention. It is intended that the present invention include such modificiations and variations as come within the scope of the appended claims and their equivalents.

What is claimed is:

1. A system in a spin draw texturizing or draw texturizing textile machine for guiding bundles of fibrils through a texturizing devices comprising:

a texturizing unit including a plurality of texturizing nozzles, each said nozzle having a transporting portion and a texturizing portion in which said bundles of fibrils are texturized;

a pair of draw rolls with one of said draw rolls disposed to deliver said bundles of fibrils to said texturizing device; and a false twist producing mechanism configured relative to each of said texturizing nozzles so as to produce a twist in said bundle of fibrils that extends from said false twist producing mechanism back to said draw roll, said false twist producing mechanism configured to produce a single direction twist so as to cause said bundle of fibrils to roll on said draw roll in a direction that increases tension in said bundle of fibrils between said draw roll and said texturizing nozzle until the increase in tension causes said bundle of fibrils to stop at a stable position on said draw roll.

2. The system as in claim 1, wherein said false twist producing mechanism is configured directly with said texturizing nozzles such that the false twist extends from an inlet of said texturizing nozzles back to said draw roll.

3. The system as in claim 2, wherein said false twist producing mechanism comprises air ducts disposed in communication with said inlet, said air ducts disposed at an angle and supplied with pressurized air so as to impart said false twist to said bundle of fibrils within said inlet.

4. The system as in claim 1, wherein said false twist producing mechanism is disposed between said texturizing nozzles and said draw roll.

5. The system as in claim 1, wherein said texturizing nozzles comprise an exchangeable element having said inlet portion defined therethrough, said air ducts comprising spiral ducts defined in said exchangeable element.

* * * * *